US011542719B2

(12) United States Patent
Chen et al.

(10) Patent No.: US 11,542,719 B2
(45) Date of Patent: Jan. 3, 2023

(54) FLEXIBLE CONNECTING STRUCTURE OF PREFABRICATED COMPONENT AND BUILDING MAIN BODY

(71) Applicants: Hunan Construction Engineering Group Co., Ltd., Changsha (CN); Hunan Construction Technology Research Institute, Changsha (CN)

(72) Inventors: Hao Chen, Changsha (CN); Weichao Chen, Changsha (CN); Weijun Tang, Changsha (CN); Mingliang Zhang, Changsha (CN); Qingfeng Dai, Changsha (CN); Tuo Shi, Changsha (CN); Zengguang Wang, Changsha (CN); Qinglian Yuan, Changsha (CN); Wei Liu, Changsha (CN)

(73) Assignees: HUNAN CONSTRUCTION ENGINEERING GROUP CO., LTD., Changsha (CN); HUNAN CONSTRUCTION TECHNOLOGY RESEARCH INSTITUTE, Changsha (CN)

( * ) Notice: Subject to any disclaimer, the term of this patent is extended or adjusted under 35 U.S.C. 154(b) by 123 days.

(21) Appl. No.: 16/883,207

(22) Filed: May 26, 2020

(65) Prior Publication Data

US 2020/0378145 A1 Dec. 3, 2020

(30) Foreign Application Priority Data

May 31, 2019 (CN) ..... 201910465974.X
May 31, 2019 (CN) ..... 201910465982.4

(51) Int. Cl.
*E04B 1/38* (2006.01)
*E04B 1/344* (2006.01)
(Continued)

(52) U.S. Cl.
CPC ..... *E04H 9/021* (2013.01); *E04B 1/383* (2013.01); *E04B 1/40* (2013.01); *E04B 1/98* (2013.01)

(58) Field of Classification Search
CPC ... E04B 1/40; E04B 1/98; E04B 1/383; E04B 1/344; E04H 9/021
(Continued)

(56) References Cited

U.S. PATENT DOCUMENTS 3,724,141 A * 4/1973 Kelleher ..... E04B 1/34823 52/79.14
4,184,296 A * 1/1980 Vitalini ..... E04B 1/34823 52/236.7
(Continued)

FOREIGN PATENT DOCUMENTS

CN 105672485 A 6/2016
CN 106760164 A 5/2017
(Continued)

OTHER PUBLICATIONS

English Abstract for CN 105672485 A (2016).
(Continued)

*Primary Examiner* — Brian E Glessner
*Assistant Examiner* — James J Buckle, Jr.
(74) *Attorney, Agent, or Firm* — Caesar Rivise, PC

(57) ABSTRACT

The present invention discloses a flexible connecting structure of a prefabricated component and a building main body. The flexible connecting structure comprises multiple layers of cast-in-situ building main bodies spaced up and down, a prefabricated component is connected between two adjacent cast-in-situ building main bodies, a tenon is provided at the lower end of the prefabricated component, a mortise matching the tenon is provided on the top surface of the cast-in-situ building main body, and the prefabricated component is
(Continued)

socketed to the lower layer of cast-in-situ building main body by tenon-and-mortise cooperation; and a first flexible layer for reducing the connection rigidity between the prefabricated component and the upper layer of cast-in-situ building main body is provided at the junction between the prefabricated component and the upper layer of cast-in-situ building main body. The present invention realizes a flexible connection between a prefabricated component and a building main body, and avoids the influence of the prefabricated component on the rigidity of the building main body.

10 Claims, 3 Drawing Sheets

(51) Int. Cl.

| | |
|---|---|
| ***E04B 1/35*** | (2006.01) |
| ***E04H 9/02*** | (2006.01) |
| ***E04B 1/98*** | (2006.01) |
| ***E04B 1/41*** | (2006.01) |

(58) Field of Classification Search
USPC ..... 52/79.1
See application file for complete search history.

(56) References Cited

U.S. PATENT DOCUMENTS

| | | | | |
|---|---|---|---|---|
| 4,277,921 | A * | 7/1981 | Gianfranco | E04C 3/20 52/236.7 |
| 5,081,805 | A * | 1/1992 | Jazzar | E04B 1/34823 52/79.14 |
| 8,919,058 | B2 * | 12/2014 | Liberman | E04B 1/34384 52/79.9 |
| 9,243,398 | B2 * | 1/2016 | Liberman | E04B 5/04 |
| 10,837,187 | B2 * | 11/2020 | Wong | E04B 1/24 |
| 2002/0062616 | A1 * | 5/2002 | Ocampo | E04B 1/215 52/261 |

FOREIGN PATENT DOCUMENTS

| | | |
|---|---|---|
| CN | 208329279 U | 1/2019 |
| CN | 208749159 U | 4/2019 |

OTHER PUBLICATIONS

English Abstract for CN 106760164 A (2017).
English Abstract for CN 208329279 U (2019).
English Abstract for CN 208749159 U (2019).

* cited by examiner

FLEXIBLE CONNECTING STRUCTURE OF PREFABRICATED COMPONENT AND BUILDING MAIN BODY

CROSS-REFERENCE TO RELATED APPLICATIONS

This application claims priority to Chinese Patent Application No. 201910465974.X filed May 31, 2019 and Chinese Patent Application No. 201910465982.4 filed May 31, 2019, the contents of which applications are incorporated herein by reference in their entireties for all purposes.

FIELD OF THE INVENTION

The present invention belongs to the field of assembly-type building industrialization, and particularly relates to a flexible connecting structure of a prefabricated component and a building main body.

BACKGROUND OF THE INVENTION

Assembly-type components have the characteristics of standardized design, factory production, assembly-type construction, energy saving and consumption reduction, environmental protection, short construction period, improved quality and the like, and can promote deep integration of informatization and industrialization. Therefore, assembly-type buildings have been vigorously developed and applied. Prefabricated toilets or prefabricated kitchens can achieve standardized design, factory production and assembly-type construction, have the advantages of integrity, good quality and the like, and assembly-type prefabricated toilets or prefabricated kitchens are used as integral prefabricated units in assembly-type buildings.

At present, there are two types of connection methods for assembly-type nodes: wet connection and dry connection. The wet connection includes grout anchor connection, ordinary post-cast integral connection, ordinary cast-in-situ connection, grout assembly, reinforced sleeve grouting connection, etc. The dry connection includes mechanical sleeve connection, pre-stressed crimp connection, corbel connection, welding connection, bolt connection, etc. The wet connection is good in integrity but inconvenient in construction, for example, there has no effective method for inspecting the quality of reinforced sleeve grouting connection at present. Compared with the wet connection, the existing dry connection has the characteristic of convenient construction, but is still relatively complicated, and requires corresponding operations such as tightening, tensioning and welding. Because the prefabricated toilet or prefabricated kitchen is connected between the upper and lower layers of building main bodies, and the overall rigidity of the prefabricated toilet or prefabricated kitchen is high, if no effective measures are taken to avoid the influence of the prefabricated toilet or prefabricated kitchen on the rigidity of the building main body, the rigidity of the original building design will be increased in the vertical and horizontal areas of prefabricated components, which produces an adverse effect on the earthquake resistance of the building.

SUMMARY OF THE INVENTION

The technical problem to be solved by the present invention is to overcome the shortcomings of the prior art, and provide a flexible connecting structure of a prefabricated component and a building main body, so as to prevent the adverse effect of the prefabricated component on the rigidity of the building main body and prevent earthquake damage.

In order to solve the above technical problems, the present invention adopts the following technical solution:

A flexible connecting structure of a prefabricated component and a building main body, including multiple layers of cast-in-situ building main bodies spaced up and down, wherein a prefabricated component is connected between two adjacent cast-in-situ building main bodies, a tenon is provided at the lower end of the prefabricated component, a mortise matching the tenon is provided on the top surface of the cast-in-situ building main body, and the prefabricated component is socketed to the lower layer of cast-in-situ building main body by tenon-and-mortise cooperation; and a first flexible layer for reducing the connection rigidity between the prefabricated component and an upper layer of cast-in-situ building main body is provided at the junction between the prefabricated component and the upper layer of cast-in-situ building main body.

The prefabricated components and the building main bodies can be assembled into a assembly-type building with an upper and lower structure by using a assembly connection manner of socketing prefabricated components and upper layers of cast-in-situ building, so that not only the convenience and efficiency of assembly are improved, but also the quality of connection nodes is reliable.

The applicant continued to conduct in-depth research on the assembly connection mode of socketing prefabricated components and upper layers of cast-in-situ building, and the results show that when the integral prefabricated component and the building main structure are connected into a whole, although the structural stability of the overall structure is increased, the rigidity at the junction between the prefabricated component and the upper layer of cast-in-situ building is relatively high, which results in uneven overall rigidity and more complex force, and changes the rigidity of the original building design, so that the building is more vulnerable to earthquakes or wind shocks. Therefore, effective measures or methods are required to achieve a flexible connection between the overall prefabricated component and the building main structure, so as to prevent the prefabricated component from producing an adverse effect on the rigidity of the building main structure.

In the present invention, a flexible layer is provided at the junction between the prefabricated component and the upper layer of cast-in-situ building main body to separate the prefabricated component from the building main body, so that the prefabricated component does not participate in the stress on the building main structure. Since the connection between the prefabricated component and the lower layer of building main structure is a hinged connection, no bending moment is transmitted between each other, the load generated by the toilet only generates certain vertical axial force and additional torque for the building main structure, and the internal force in this part is very small and basically negligible on the force of the entire main structure system. In addition, under the action of wind load and horizontal earthquake, although the overall rigidity of the prefabricated component is relatively high, because a flexible layer is provided between the prefabricated component and the building main structure and does not participate in the stress on the main structure, the prefabricated component will produce certain horizontal force on the building main structure at the floor under the action of horizontal earthquake. However, this horizontal force is very small and borne by the floor, and the rigidity of the floor in the direction of this horizontal force is very high, so the impact of the horizontal force can be ignored. Therefore, the force influence of the toilet on the entire main structure system is small and can be ignored.

As a further improvement of the above technical solution: The first flexible layer is a polystyrene foam layer, and the thickness of the first flexible layer is 15 to 25 mm.

A hook is embedded in the upper part of the prefabricated component, and the hook passes through the first flexible layer and then extends into the upper layer of cast-in-situ building main body. The hook is used as a structural tie to ensure the structural stability of the toilet.

A cast-in-situ shear wall connecting the upper and lower layers of cast-in-situ building main bodies is disposed as a load-bearing main structure on the external wall of the prefabricated component. A second flexible layer for reducing the connection rigidity between the prefabricated component and the cast-in-situ shear wall is provided at the junction between the prefabricated component and the cast-in-situ shear wall. Therefore, the prefabricated component will not affect the force of the cast-in-situ load-bearing shear wall of the building main structure.

The second flexible layer is a polystyrene foam layer, and the thickness of the second flexible layer is 20 to 30 mm. The polystyrene foam layer is preferably a flame-retardant extruded polystyrene board, which can not only reduce the influence of the prefabricated component on the load-bearing shear wall, but also meet the requirements of energy saving and thermal insulation.

The prefabricated component is a prefabricated toilet or a prefabricated kitchen. The mortise is preferably a square mortise.

A support step is provided on the inner wall of the mortise, and the prefabricated component is supported on the support step to realize a simple support connection between the prefabricated component and the building main body; and a leveling layer is provided at the junction between the support step and the prefabricated component.

A filling layer is provided in a gap between the cast-in-situ building main body and the prefabricated component; and the filling layer is above the leveling layer.

Preferably, the filling layer includes a fine sand layer, a polyethylene rod layer, and a polyurethane adhesive layer in sequence from bottom to top.

Preferably, the leveling layer is a cement mortar leveling layer, and the thickness of the cement mortar leveling layer is 15 to 25 mm.

The lower part of the prefabricated component forms the tenon, and the upper part of the prefabricated component forms a prefabricated component main body; at least one side wall of the tenon is contracted inward, and the support step includes a first support step supporting the lower end surface of the prefabricated component main body, and/or a second support step supporting the lower end surface of the tenon.

As a general inventive concept, the present invention also provides a construction method of the flexible connecting structure of a prefabricated component and a building main body, including the following steps:

S1: casting a bottom layer of building main body to obtain a bottom layer of cast-in-situ building main body;

S2: socketing a tenon of a prefabricated component to a mortise of the cast-in-situ building main body;

S3: laying a first flexible layer on the top surface of the socketed prefabricated component;

S4: casting an upper layer of building main body on the first flexible layer to obtain an upper layer of cast-in-situ building main body; and S5: repeating steps S2-S4 to complete flexible connections between prefabricated components and building main bodies.

As a further improvement of the above technical solution: A cast-in-situ shear wall connecting the upper and lower layers of cast-in-situ building main bodies is disposed on the external wall of the prefabricated component, and a second flexible layer for reducing the connection rigidity between the prefabricated component and the cast-in-situ shear wall is provided at the junction between the prefabricated component and the cast-in-situ shear wall; and step S4 further includes: laying the second flexible layer on the external wall of the prefabricated component; and casting the shear wall on the outer side of the second flexible layer.

Before step S2, the method also includes: laying a leveling layer on the upper surface of the support step.

After step S4, the method also includes: laying a filling layer in a gap between the building main body and the prefabricated component, the filling layer being above the leveling layer.

Compared with the prior art, the advantages of the present invention are:

1. The present invention realizes a flexible connection between a prefabricated component (e.g., a prefabricated kitchen, a prefabricated toilet, etc.) and a building main body (e.g., a horizontal floor, etc.), and avoids the influence of the prefabricated component on the rigidity of the building main body.

2. The present invention is simple in structure and convenient in construction, and has a broad application prospect.

Reference signs: 1, prefabricated component; 11, tenon; 2, cast-in-situ building main body; 21, mortise; 3, first flexible layer; 4, hook; 5, cast-in-situ shear wall; 6, second flexible layer; 22, support step; 221, first support step; 222, second support step; 7, leveling layer; 8, filling layer; 81, polyurethane adhesive layer; 82, polyethylene rod layer; 83, fine sand layer.

DETAILED DESCRIPTION OF EMBODIMENTS

The present invention will be further described below with reference to specific preferred embodiments, but the scope of protection of the present invention is not limited thereby.

Embodiment 1

Figure 1:
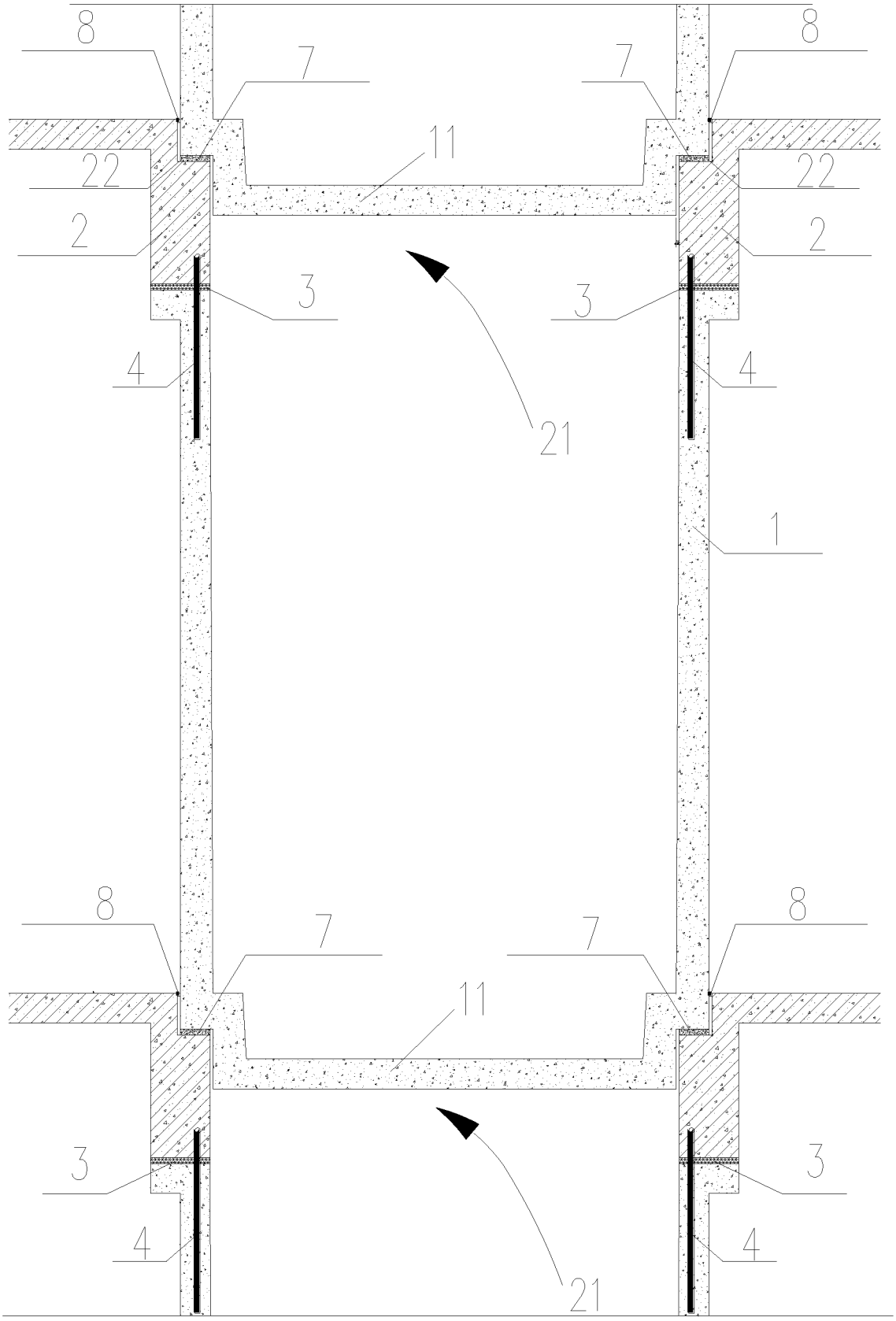
FIG. 1 is a schematic diagram of a flexible connecting structure of a prefabricated component and a building main body according to Embodiment 1 of the present invention.
Figure 2:
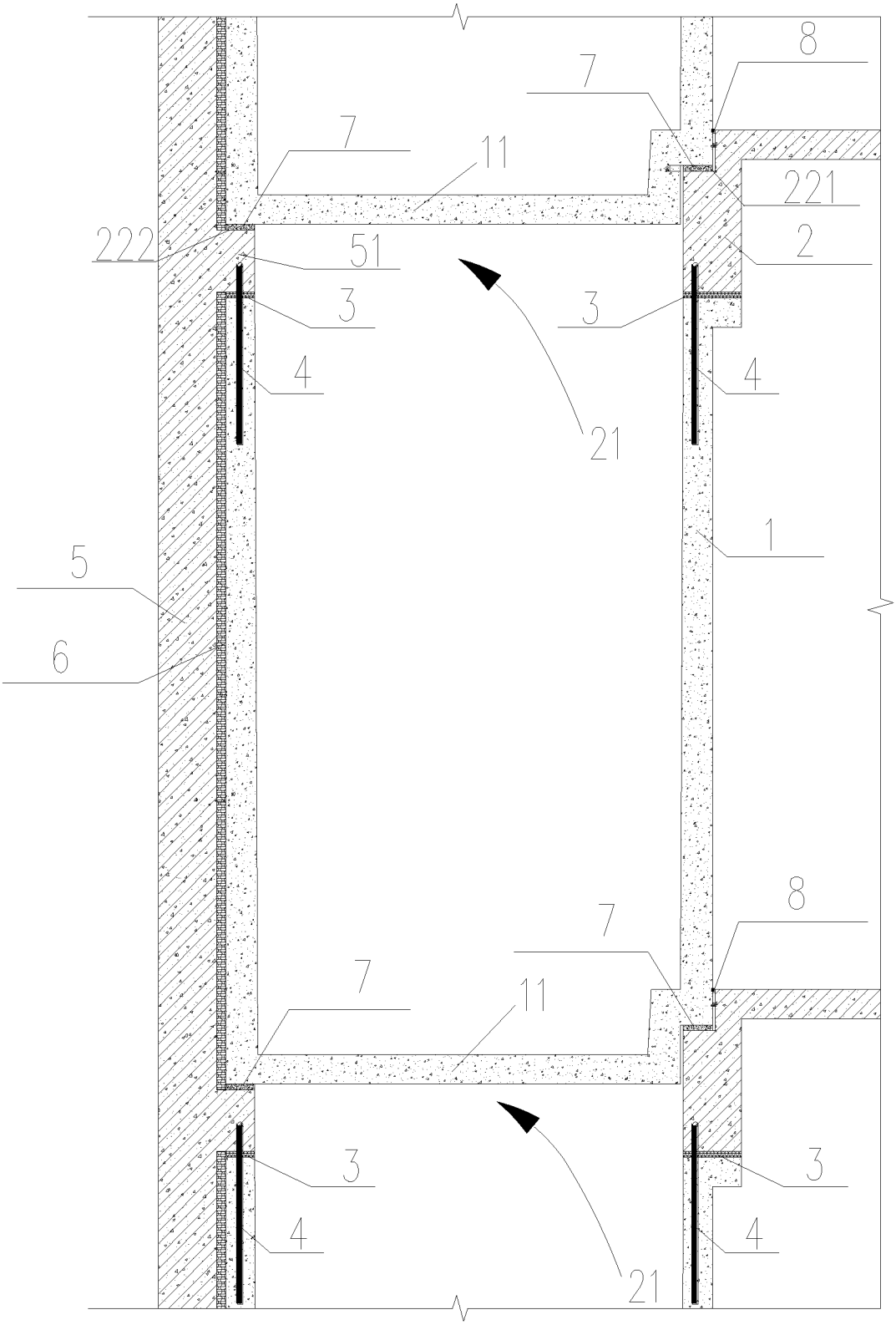
FIG. 2 is a schematic diagram of a flexible connecting structure of a prefabricated component and a building main body according to Embodiment 2 of the present invention.

As shown in FIG. 1, a flexible connecting structure of a prefabricated component and a building main body in this embodiment includes multiple layers of cast-in-situ building main bodies 2 spaced up and down, and a prefabricated component 1 is connected between two adjacent cast-in-situ building main bodies 2. In this embodiment, the cast-in-situ building main bodies 2 are floor slabs, each floor slab is provided with a square mortise 21, and the wall of the mortise 21 is enclosed and reinforced by four floor beams. The prefabricated component 1 is a prefabricated toilet, the lower parts of four side walls of the prefabricated component 1 are all contracted inward to form a tenon 11 matching the mortise 21, and the upper part of the prefabricated component 1 forms a prefabricated component main body.

The prefabricated component 1 is socketed to the lower layer of cast-in-situ building main body 2 by tenon-and-mortise cooperation; the inner wall of the mortise 21 is provided with a support step 22, and the lower end surface of the prefabricated component main body is supported on the support step 22. In addition, a leveling layer 7 is provided at the junction between the support step 22 and the prefabricated component 1. The leveling layer 7 is a cement mortar leveling layer, and the thickness of the cement mortar leveling layer is 15 to 25 mm.

A first flexible layer 3 for reducing the connection rigidity between the prefabricated component 1 and the upper layer of cast-in-situ building main body 2 is provided at the junction between the prefabricated component 1 and the upper layer of cast-in-situ building main body 2. The first flexible layer 3 is a polystyrene foam layer, and the thickness of the first flexible layer 3 is 15 to 25 mm. A hook 4 is embedded in the upper part of the prefabricated component 1, and the hook 4 passes through the first flexible layer 3 and then extends into the upper layer of cast-in-situ building main body 2.

Figure 3:
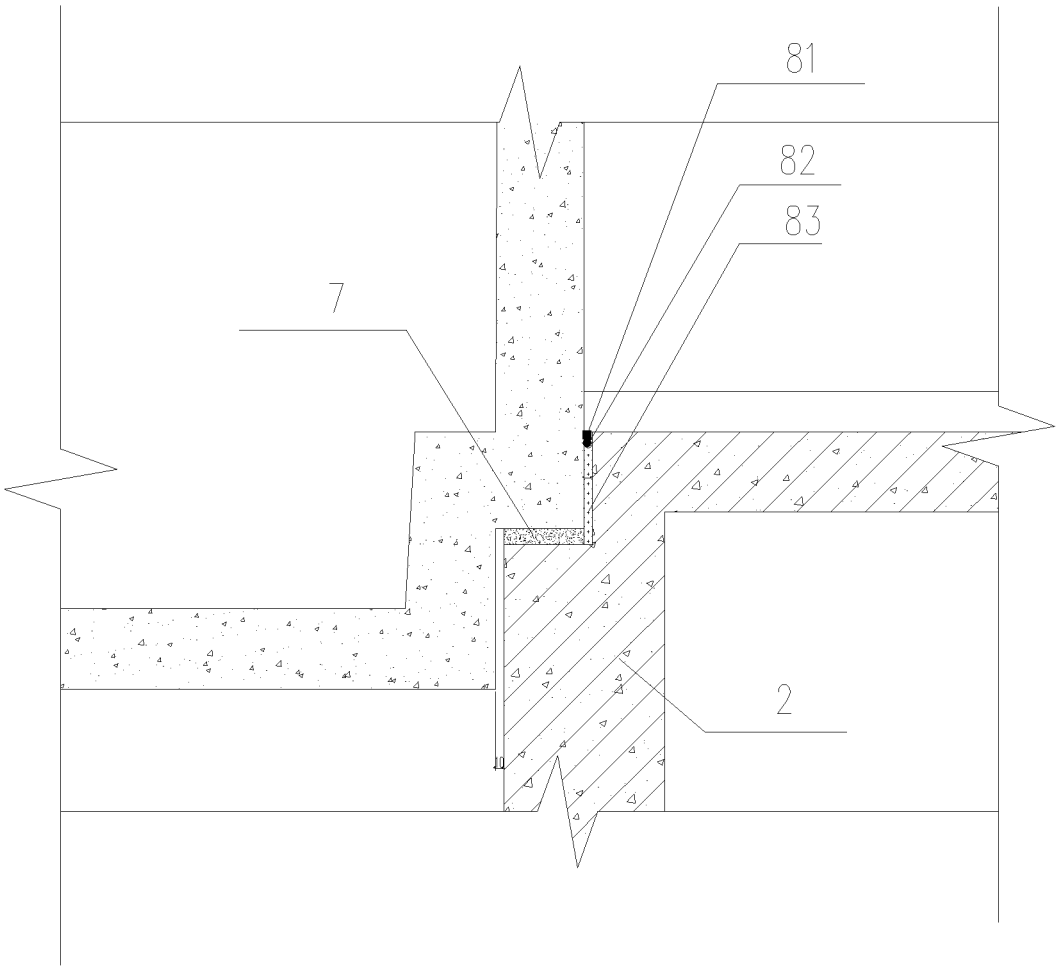
FIG. 3 is a partially enlarged view of a junction between a prefabricated component and a building main body in the present invention.

A filling layer 8 is provided in a gap between the cast-in-situ building main body 2 and the prefabricated component 1; and the filling layer 8 is above the leveling layer 7. As shown in FIG. 3, the filling layer 8 includes a fine sand layer 83, a polyethylene rod layer 82, and a polyurethane adhesive layer 81 in sequence from bottom to top.

A construction method of the flexible connecting structure of a prefabricated component and a building main body in this embodiment includes the following steps:

S1: casting a bottom layer of building main body to obtain a bottom layer of cast-in-situ building main body 2, wherein four floor beams enclose a mortise 21 after casting.

S2: laying a cement mortar leveling layer on a support step 22 of the mortise 21.

S3: socketing the prefabricated component 1 to the cast-in-situ building main body 2, wherein the prefabricated component main body is supported by the support step 22.

S4: laying the first flexible layer 3 on the top surface of the side wall of the socketed prefabricated component 1.

S5: casting an upper layer of building main body on the first flexible layer 3 to obtain an upper layer of cast-in-situ building main body 2, wherein four floor beams enclose a mortise 21 after casting. A hook 4 of the prefabricated component 1 passes through the first flexible layer 3 and then extends into the upper layer of cast-in-situ building main body 2.

S6: laying a filling layer 8 in a gap between the building main body 2 and the prefabricated component 1, wherein the filling layer 8 is above the leveling layer 7.

S7: repeating steps S2-S6 to obtain the flexible connecting structure of the prefabricated component and the building main body.

Embodiment 2

A flexible connecting structure of a prefabricated component and a building main body in this embodiment includes multiple layers of cast-in-situ building main bodies 2 spaced up and down, and a prefabricated component 1 is connected between two adjacent cast-in-situ building main bodies 2. In this embodiment, the cast-in-situ building main bodies 2 are floor slabs.

A cast-in-situ shear wall 5 connecting the upper and lower layers of cast-in-situ building main bodies 2 is disposed on the external wall of one side wall of the prefabricated component 1, and a second flexible layer 6 for reducing the connection rigidity between the prefabricated component 1 and the cast-in-situ shear wall 5 is provided at the junction between the prefabricated component 1 and the cast-in-situ shear wall 5. The second flexible layer 6 is a polystyrene foam layer, and the thickness of the second flexible layer 6 is 20 to 30 mm. Lifting lugs extending toward the building main body 2 are provided both at the upper and lower ends of the cast-in-situ shear wall 5.

Each floor slab is provided with a square mortise 21, and the side of the mortise 21 opposite to the cast-in-situ shear wall 5 extends to the cast-in-situ shear wall 5. The wall of the mortise 21 is enclosed and reinforced by three floor beams and lifting lugs.

The prefabricated component 1 is a prefabricated toilet, the lower parts of three side walls of the prefabricated component 1 corresponding to the three floor beams are contracted inward to form a tenon 11 matching the mortise 21, and the prefabricated component 1 above the tenon 11 forms a prefabricated component main body.

The prefabricated component 1 is socketed to the lower layer of cast-in-situ building main body 2 by tenon-and-mortise cooperation; three first support steps 221 are respectively provided on the internal walls of the three side walls of the mortise 21 corresponding to the three floor beams, and the lifting lug form a second support step 222. The lower end surface of the prefabricated component main body is supported on the first support steps 221, and the side wall of the tenon 11 corresponding to the lifting lug are supported on the second support step 222.

A leveling layer 7 is provided on each of the first support steps 221 and the second support steps 222. The leveling layer 7 is a cement mortar leveling layer, and the thickness of the cement mortar leveling layer is 15 to 25 mm.

A first flexible layer 3 for reducing the connection rigidity between the prefabricated component 1 and the upper layer of cast-in-situ building main body 2 is provided at the junction between the prefabricated component 1 and the upper layer of cast-in-situ building main body 2. The first flexible layer 3 is a polystyrene foam layer, and the thickness of the first flexible layer 3 is 15 to 25 mm. A hook 4 is embedded in the upper part of the prefabricated component 1, and the hook 4 passes through the first flexible layer 3 and then extends into the upper layer of cast-in-situ building main body 2.

A filling layer 8 is provided in a gap between the cast-in-situ building main body 2 and the prefabricated component 1; and the filling layer 8 is above the leveling layer 7.

A construction method of the flexible connecting structure of a prefabricated component and a building main body in this embodiment includes the following steps:

S1: casting a bottom layer of building main body and a lifting lug, a bottom layer of cast-in-situ building main body 2 is obtained, wherein the lifting lugs and three floor beams enclose a mortise 21 after casting.

S2: laying a cement mortar leveling layer on the first support step 221 and the second support step 222 on the internal walls of the mortise 21.

S3: socketing a prefabricated component 1 to the cast-in-situ building main body 2, wherein the prefabricated component is supported by the first support step 221 and the second support step 222.

S4: laying a first flexible layer 3 on the top surface of the side wall of the socketed prefabricated component 1.

S5: casting an upper layer of building main body on the first flexible layer 3 to obtain an upper layer of cast-in-situ building main body 2, and casting a shear wall 5 and an upper layer of lifting lug on the external wall of the prefabricated component 1. The lifting lug and three floor beams enclose a mortise 21 after casting. In addition, a hook 4 of the prefabricated component 1 passes through the first flexible layer 3 and then extends into the upper layer of cast-in-situ building main body 2.

S6: laying a filling layer 8 in the gap between the building main body 2 and the prefabricated component 1, wherein the filling layer 8 is above the leveling layer 7.

S7: repeating steps S2-S6 to obtain the flexible connecting structure of the prefabricated component and the building main body.

The force influence of the prefabricated toilet in the present invention on the entire structural system is analyzed as follows:

The connection between the toilet and the main structure is a hinged connection: the lower end of the toilet has a socket-type mortise structure, which is directly inserted into a reserved hole of the floor, and placed on notch beams on four sides of the reserved hole of the floor or on the lifting lugs of the shear wall to form a simple support connection; a 20 mm thick polystyrene board is directly disposed on the top surface of the side walls of the toilet and the notch beams on four sides or on the bottom surface of the lifting lugs of the shear wall to separate the side walls of the toilet from the notch beams or the lifting lugs of the shear wall, and a structural tie is formed by embedding the hooks on four sides of the toilet into the notch beams on four sides or the lifting lugs of the shear wall, so that the side walls of the toilet do not participate in the stress on the notch beams of the main structure or the lifting lugs of the shear wall; when a cast-in-situ load-bearing shear wall of the main structure is outside the side walls of the toilet, a 25 mm thick flame-retardant extruded polystyrene board is disposed between the side walls of the toilet and the cast-in-situ load-bearing shear wall, so that the toilet will not affect the stress on the cast-in-situ load-bearing shear wall of the main structure while meeting the requirements for energy saving and thermal insulation. It can be seen from the above connection types and measures of various parts of the toilet and the main structure that the load generated by the toilet only produces internal force influence on the horizontal component of the main structure; when the horizontal component of the main structure is designed, the corresponding load is considered according to the design parameters of the toilet for component design; since the connection between the toilet and the vertical component of the main structure is a hinged connection, no bending moment is transmitted between each other, the load generated by the toilet only generates certain vertical axial force and additional torque for the vertical component of the main structure, and the internal force in this part is very small and basically negligible on the force of the entire main structure system. In addition, under the action of wind load and horizontal earthquake, although the overall rigidity of the toilet is relatively high, because a polystyrene board is disposed between the toilet and the main structure and does not participate in the stress on the main structure, the toilet will produce certain horizontal force on the main structure at the floor under the action of horizontal earthquake. However, this horizontal force is very small and borne by the floor, and the rigidity of the floor under this horizontal force is very high, so the impact of the horizontal force can be ignored. Therefore, the force influence of the toilet on the entire main structure system is small and can be ignored.

The forgoing descriptions are only preferred embodiments of the present application, and do not limit the present application in any form. Although the present application is disclosed above with the preferred embodiments, the present application is not limited thereto. Some variations or modifications made by any skilled person familiar with the art using the disclosed technical contents without departing from the scope of the technical solution of the present application are equivalent to the equivalent embodiments, and all fall within the scope of the technical solution.

What is claimed is:

1. A flexible connecting structure of a prefabricated component and a building main body, wherein the flexible connecting structure comprises multiple layers of cast-in-situ building main bodies spaced up and down, a prefabricated component is connected between two adjacent cast-in-situ building main bodies, a tenon is provided at a lower end of the prefabricated component, a mortise matching the tenon is provided on a top surface of the cast-in-situ building main body, and the prefabricated component is socketed to a lower layer of the cast-in-situ building main body by tenon-and-mortise cooperation; and a first flexible layer for reducing the connection rigidity between the prefabricated component and an upper layer of the cast-in-situ building main body is provided at a junction between the prefabricated component and the upper layer of the cast-in-situ building main body, the socketed connection between the prefabricated component and the lower layer of the cast-in-situ building main body is a hinged connection.

2. The flexible connecting structure of the prefabricated component and the building main body according to claim 1, wherein a cast-in-situ shear wall connecting the upper and lower layers of cast-in-situ building main bodies is disposed on an external wall of the prefabricated component, and a second flexible layer for reducing the connection rigidity between the prefabricated component and the cast-in-situ shear wall is provided at the junction between the prefabricated component and the cast-in-situ shear wall.

3. The flexible connecting structure of the prefabricated component and the building main body according to claim 2, wherein the first flexible layer and the second flexible layer are both polystyrene foam layers.

4. The flexible connecting structure of the prefabricated component and the building main body according to claim 1, wherein a hook is embedded in an upper part of the prefabricated component, and the hook passes through the first flexible layer and then extends into the upper layer of cast-in-situ building main body.

5. The flexible connecting structure of the prefabricated component and the building main body according to claim 1, wherein the prefabricated component is a prefabricated toilet or a prefabricated kitchen.

6. The flexible connecting structure of the prefabricated component and the building main body according to claim 5, wherein a support step is provided on an inner wall of the mortise, and the prefabricated component is supported on the support step; and a leveling layer is provided at the junction between the support step and the prefabricated component.

7. The flexible connecting structure of the prefabricated component and the building main body according to claim 6, wherein a filling layer is provided in a gap between the cast-in-situ building main body and the prefabricated component; and the filling layer is above the leveling layer.

8. The flexible connecting structure of the prefabricated component and the building main body according to claim 6, wherein a lower part of the prefabricated component forms the tenon, and an upper part of the prefabricated component forms a prefabricated component main body; at least one side wall of the tenon is contracted inward, and the support step comprises a first support step supporting a lower end surface of the prefabricated component main body, and/or a second support step supporting a lower end surface of the tenon.

9. A construction method of a flexible connecting structure of a prefabricated component and a building main body, wherein the flexible connecting structure of the prefabricated component and the building main body comprises multiple layers of cast-in-situ building main bodies spaced up and down, a prefabricated component is connected between two adjacent cast-in-situ building main bodies, a tenon is provided at a lower end of the prefabricated component, a mortise matching the tenon is provided on a top surface of the cast-in-situ building main body, and the prefabricated component is socketed to a lower layer of the cast-in-situ building main body by tenon-and-mortise cooperation; and a first flexible layer for reducing the connection rigidity between the prefabricated component and an upper layer of the cast-in-situ building main body is provided at a junction between the prefabricated component and the upper layer of the cast-in-situ building main body, and the construction method of the said flexible connecting structure of the prefabricated component and the building main body comprises the following steps:

S1: casting a bottom layer of building main body to obtain a bottom layer of cast-in-situ building main body;

S2: socketing the tenon of the prefabricated component to the mortise of the cast-in-situ building main body;

S3: laying the first flexible layer on a top surface of the socketed prefabricated component;

S4: casting an upper layer of building main body on the first flexible layer to obtain an upper layer of cast-in-situ building main body; and S5: repeating steps S2-S4 to complete flexible connections between prefabricated components and building main bodies, wherein the flexible connections between the prefabricated components and the lower layer of the cast-in-situ building main bodies are hinged connections.

10. The construction method of the flexible connecting structure of the prefabricated component and the building main body according to claim 9, wherein a cast-in-situ shear wall connecting the upper and lower layers of cast-in-situ building main bodies is disposed on an external wall of the prefabricated component, and a second flexible layer for reducing the connection rigidity between the prefabricated component and the cast-in-situ shear wall is provided at the junction between the prefabricated component and the cast-in-situ shear wall; and step S4 further comprises: laying the second flexible layer on the external wall of the prefabricated component; and casting the shear wall on an outer side of the second flexible layer.

* * * * *